US010104916B2

(12) United States Patent
Barski

(10) Patent No.: US 10,104,916 B2
(45) Date of Patent: Oct. 23, 2018

(54) MULTI-PURPOSE GARMENT FOR INFANTS

(71) Applicant: Karen H Barski, Milton, GA (US)

(72) Inventor: Karen H Barski, Milton, GA (US)

( * ) Notice: Subject to any disclaimer, the term of this patent is extended or adjusted under 35 U.S.C. 154(b) by 171 days.

(21) Appl. No.: 15/164,527

(22) Filed: May 25, 2016

(65) Prior Publication Data

US 2016/0353809 A1 Dec. 8, 2016

Related U.S. Application Data

(60) Provisional application No. 62/170,249, filed on Jun. 3, 2015, provisional application No. 62/203,585, filed on Aug. 11, 2015.

(51) Int. Cl.
*A41B 13/06* (2006.01)
*A61J 17/00* (2006.01)

(52) U.S. Cl.
CPC ..... *A41B 13/06* (2013.01); *A61J 17/001* (2015.05)

(58) Field of Classification Search
CPC ..... A41B 13/06; A61J 17/001
See application file for complete search history.

(56) References Cited

U.S. PATENT DOCUMENTS

| | | | | |
|---|---|---|---|---|
| 1,489,046 | A | 4/1924 | Thompson | |
| 2,651,781 | A | 9/1953 | Buchholz | |
| 2,686,913 | A * | 8/1954 | Brierley | A41B 13/00 2/111 |
| 2,705,326 | A * | 4/1955 | Lahnstein | A41D 10/00 2/269 |
| 5,131,096 | A | 7/1992 | Olson | |
| 5,226,193 | A | 7/1993 | Chen | |
| 5,263,975 | A | 11/1993 | La Rocca | |
| 5,522,849 | A | 6/1996 | Xiques et al. | |
| 6,247,178 | B1 | 6/2001 | Bilda | |
| 6,393,612 | B1 | 5/2002 | Thach | |
| 8,118,364 | B2 | 2/2012 | Davis | |
| D669,659 | S | 10/2012 | Barski | |
| D696,486 | S | 12/2013 | Barski | |
| 8,607,344 | B1 * | 12/2013 | Libenzi | G06F 21/53 726/17 |
| 8,607,364 | B2 | 12/2013 | Barski | |
| D718,017 | S | 11/2014 | Barski | |
| D728,198 | S | 5/2015 | Barski | |
| D728,199 | S | 5/2015 | Barski | |
| 2008/0046010 | A1 | 2/2008 | Wood et al. | |
| 2009/0163952 | A1 | 6/2009 | Kash | |
| 2012/0311762 | A1 | 12/2012 | Aiken et al. | |

* cited by examiner

*Primary Examiner* — Richale Quinn
(74) *Attorney, Agent, or Firm* — Mark P. Stone

(57) ABSTRACT

A swaddling garment or sleep sack for infants has a main body and at least one arm sleeve which can be either removably or non-removably attached to the garment. An infant pacifier is attached, either removably or non-removably, to the remote end of the arm sleeve. A closure element is provided at the remote end of the arm sleeve to close the remote end of the arm sleeve when the pacifier is removed. The arm sleeve is formed from a material and configured such that when it is removed from the garment, can be used as a pillow or blanket for an infant.

11 Claims, 4 Drawing Sheets

MULTI-PURPOSE GARMENT FOR INFANTS

BACKGROUND OF THE INVENTION

The present invention is generally directed to infant garments including swaddling garments or sleep sacks.

U.S. Pat. No. 8,607,364, issued to the present Applicant on Dec. 17, 2013, discloses a peanut shaped swaddling garment in which the top portion of the garment has a volume which is substantially equal to the volume of the bottom portion of the garment, and in which the top and bottom portions of the garment are substantially of the same configuration and are substantially symmetrically oriented relative to the middle of the body of the garment. The disclosure of U.S. Pat. No. 8,607,364 is in its entirety expressly incorporated by reference into the present patent application.

The swaddling garment of the present application preferably is of a peanut shape configuration in which the lower portion of the main body is wider and longer than the upper portion of the main body to provide more hip room for an infant. Thus, the body of the garments, as illustrated by the drawings, is not necessarily limited to configurations in which the top and bottom portions are of substantially equal volume or configuration, or are symmetrically oriented relative to the middle of the body of the garment, although such configurations of the garments are also within the scope of the present invention. Swaddling garments of configurations other than peanut shaped, as well as conventional sleep sacks which widen in a direction from top to bottom and have substantially flat bottom end, are also within the scope of the present invention.

It is the primary object of the present invention to provide an improved multi-purpose infant garment of a convertible nature by which the garment can be worn by an infant in several forms, at the selection of the user. Other objects and advantages of the present invention will become apparent from the following description in conjunction with the drawings.

SUMMARY OF THE INVENTION

An infant garment including a swaddling garment or sleep sack for infants has at least one arm sleeve which can be either removably or non-removably attached to the main body portion or shell of the garment. An infant pacifier is attached, either removably or non-removably, to the remote end of the arm sleeve. The arm sleeve is formed from a material and configured such that when it is removed from the garment, it is convertible into a pillow or blanket for an infant.

DESCRIPTION OF THE BEST MODES FOR CARRYING OUT THE INVENTION

Figure 1:
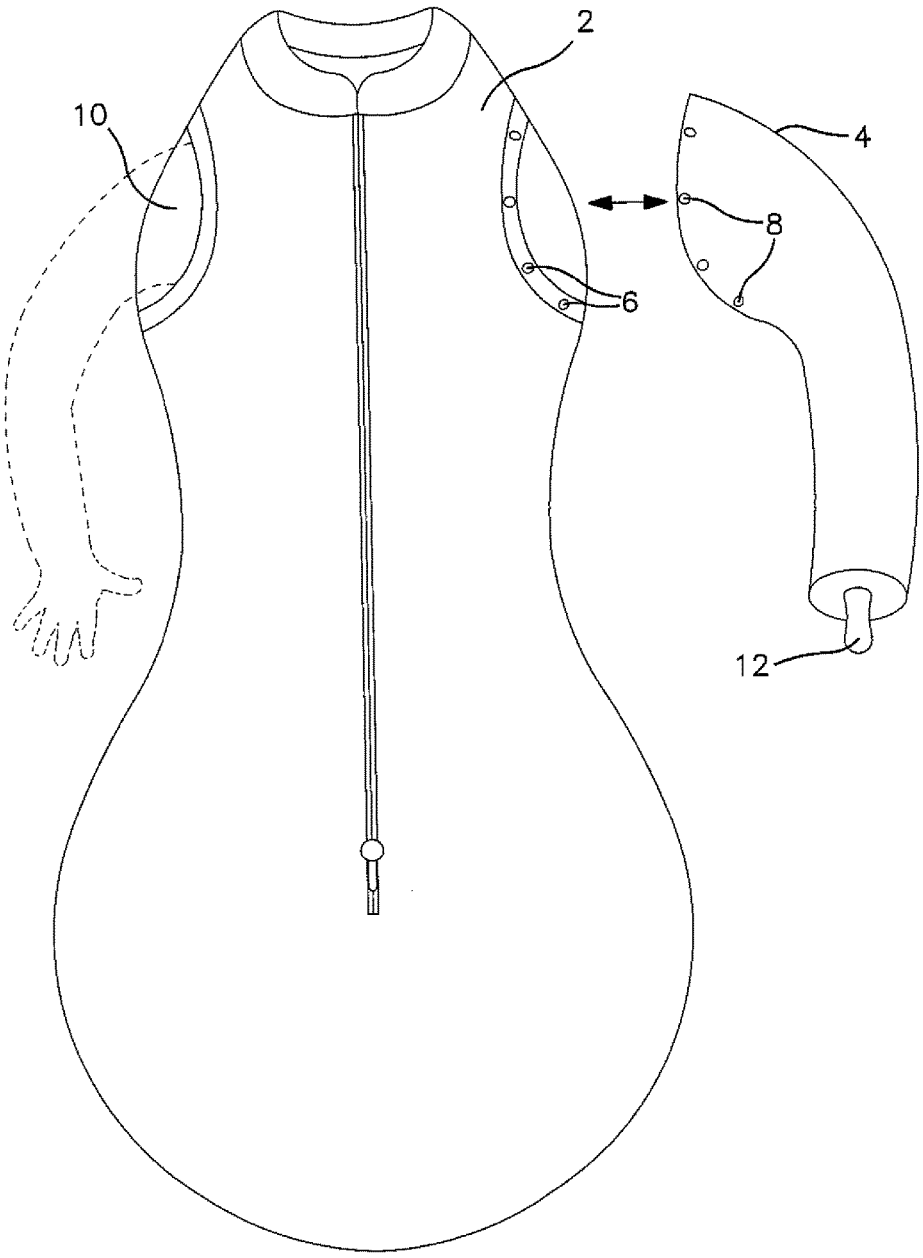
FIG. 1 illustrates a first embodiment of the invention in which an arm sleeve is removably attached to the garment and a pacifier is non-removably attached to the remote end of the arm sleeve.

Referring FIG. 1 of the drawing, reference numeral 2 generally designates the main body or shell of an infant garment such as a swaddling garment or sleep sack in accordance with the present invention. The garment includes at least one detachable arm sleeve, designated by reference numeral 4. The arm sleeve 4 is removably connected to an arm opening portion of the main body portion of the garment by conventional attachment means, as for example, complementary snaps designated by reference numerals 6 and 8 on the body of the garment and the sleeve, respectively. Other known attachment means, as for example VELCRO, can be employed.

The drawing also illustrates the arm of an infant extending from an arm opening designated by reference numeral 10 when the arm sleeve 4 has been removed from the main body portion of the garment.

The removable sleeves 4 may be formed from a soft material, such as cotton or fleece, so that the arm sleeve, when removed from the body of the garment, can be used as a security blanket or pillow for the infant.

A pacifier, designated by reference numeral 12, is non-removably attached to the remote end of at least one of the sleeves 4. The pacifier 12 may be formed integrally with the arm sleeve.

The pacifier can be used to comfort an infant both when the sleeve is attached to the body of the garment, and when the sleeve is removed from the bottom of the garment.

The garment described herein is multi-purpose. It can be used with or without sleeves, it includes a built in pacifier for an infant attached to a removable sleeve, and the removable sleeves may be formed from a material such that the sleeve can be used as a pillow or security blanket when detached from the body of the garment.

Figure 2:
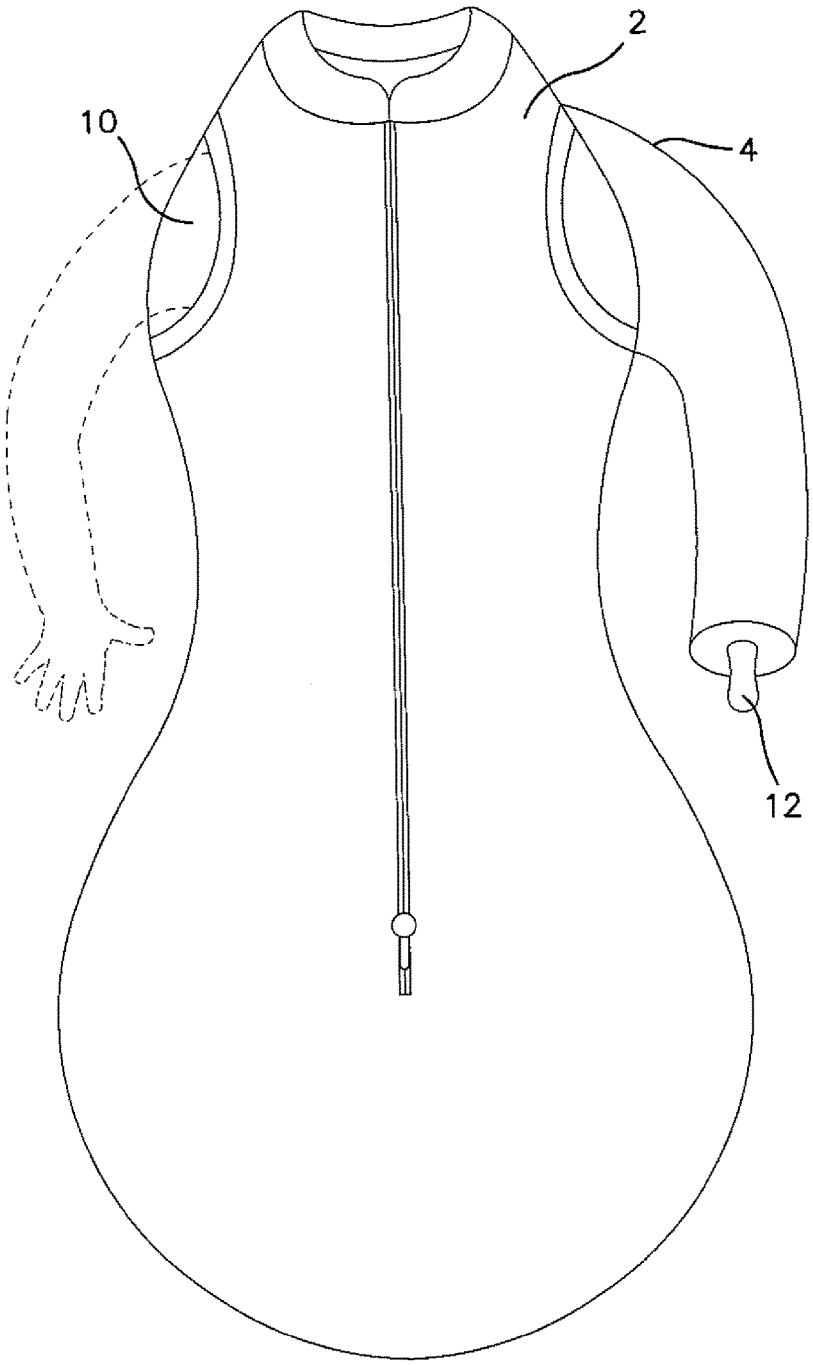
FIG. 2 illustrates a second embodiment of the invention in which an arm sleeve is non-removably attached to the garment and a pacifier is non-removably attached to the remote end of the arm sleeve.

FIG. 2 of the drawing illustrates a second embodiment of the invention, using the same reference numerals as FIG. 1 where appropriate. In this embodiment, the arm sleeve 4 is non-removably attached to the main body 2 of the garment, and can be formed integrally with the main body. As in the FIG. 1 embodiment, the pacifier 12 is non-removably attached to, or integrally formed with, the remote end of the arm sleeve 4. In this embodiment, the infant or a supervising adult may easily move the infant's arms such that the pacifier can be readily received and retained within the infant's mouth while the infant is wearing the complete garment.

Figure 3:
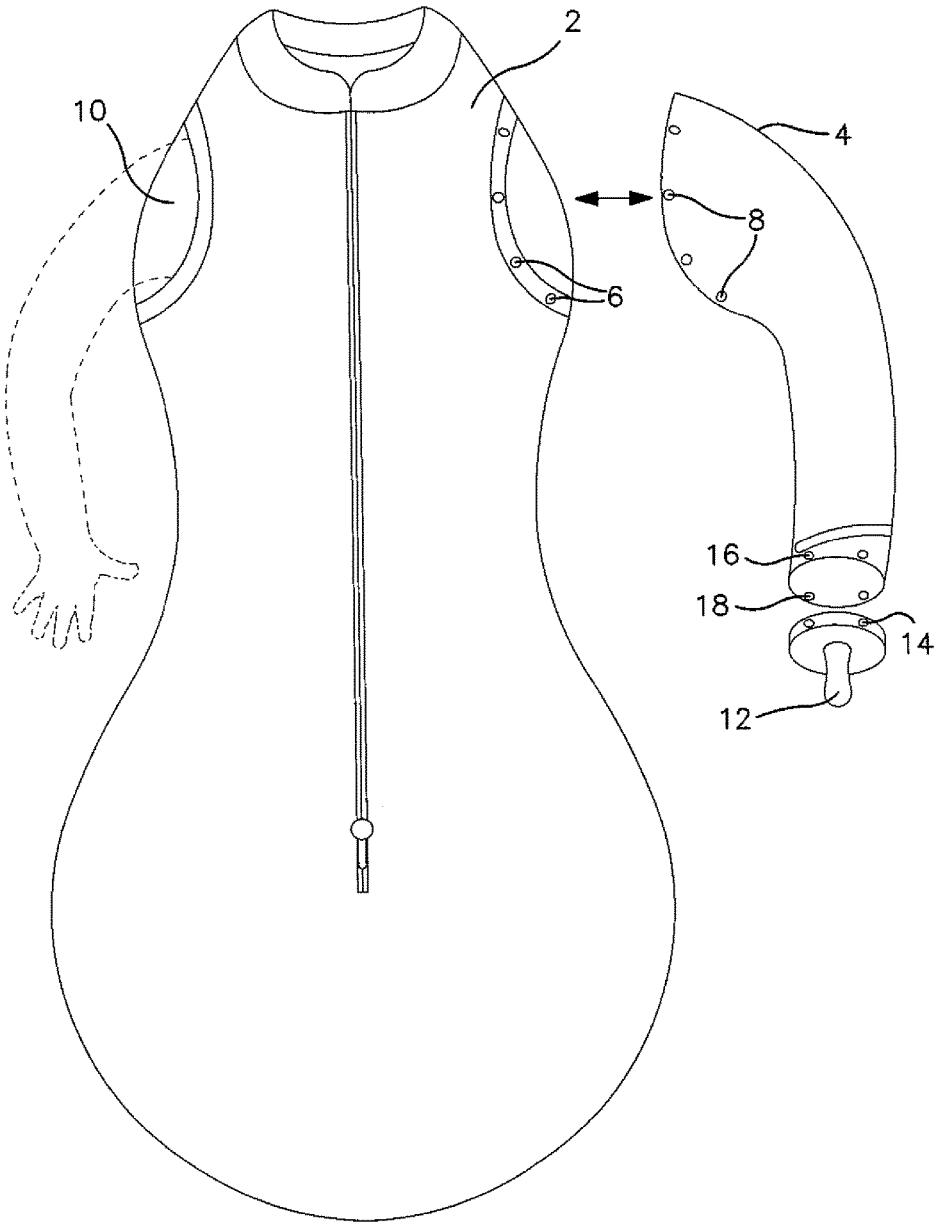
FIG. 3 illustrates a third embodiment of the invention in which an arm sleeve is removably attached to the garment and a pacifier is removably attached to the remote end of the arm sleeve.

FIG. 3 of the drawing illustrates a third embodiment of the invention, using the same reference numerals as FIGS. 1 and 2 where appropriate. In this embodiment, the arm sleeve 4 is removably attached to the main body of the garment, and the pacifier 12 is removably attached to the remote end of the removable arm sleeve by conventional means such as complementary snaps designated by reference numerals 14, 16 or VELCRO. In this manner, the arm sleeve can be removed from the garment to be used as a pillow or blanket, with or without removing the pacifier from the arm sleeve. Additionally, the pacifier can be removed from the arm sleeve without removing the arm sleeve from the main body of the garment. In this mode, conventional closure means such as snaps 18 or VELCRO can be provided at the remote end of the arm sleeve to enable the opened end of the sleeve to be closed, at the selection of the user. Moreover, the arm sleeve can be removed from the garment and the pacifier can be removed from the remote end of the arm sleeve, at the selection of the user.

Figure 4:
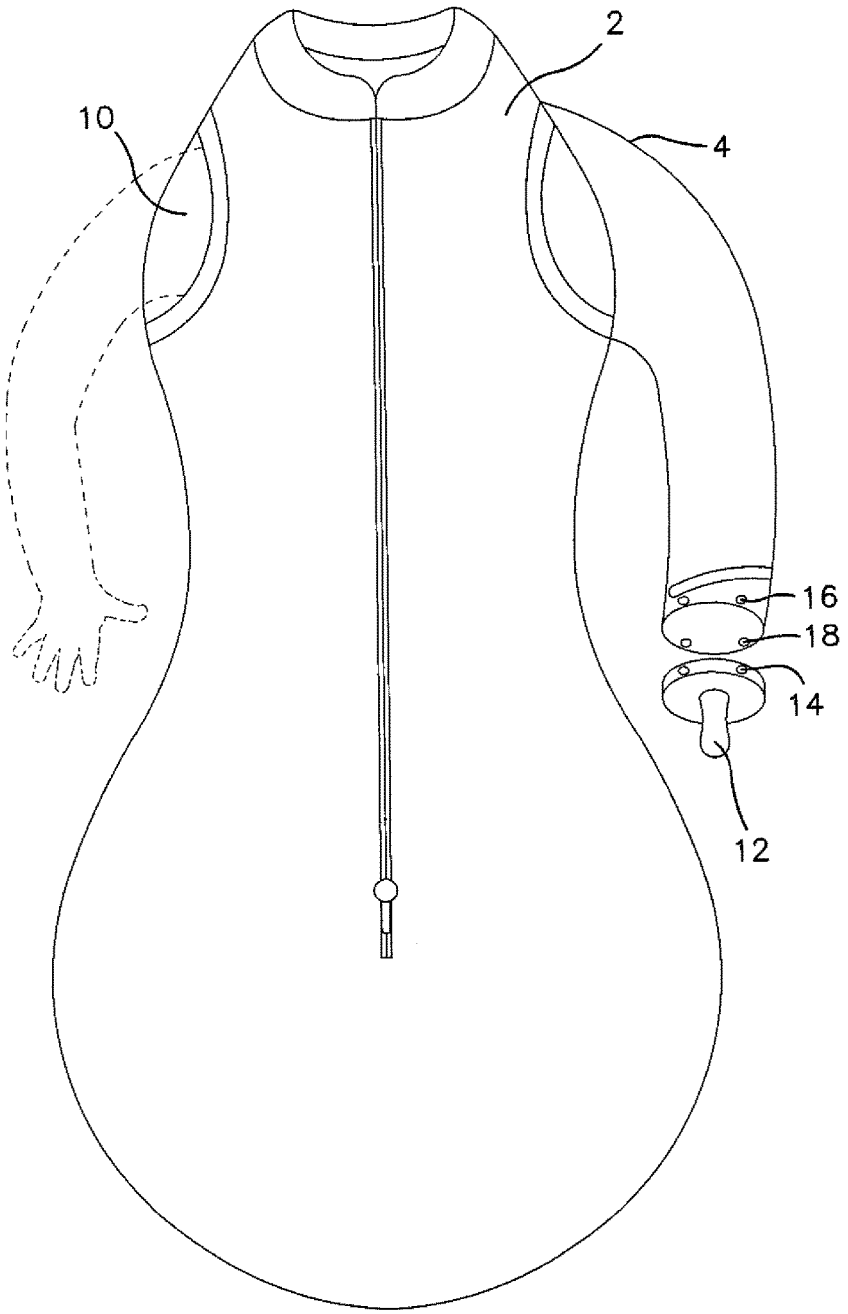
FIG. 4 illustrates a fourth embodiment of the invention in which an arm sleeve is non-removably attached to the garment and a pacifier is removably attached to the remote end of the arm sleeve.

FIG. 4 of the drawing illustrates a fourth embodiment of the invention, using the same reference numerals as FIGS. 1, 2 and 3 where appropriate. In this embodiment, the arm sleeve 4 is not removable from the main body of the garment, but the pacifier 12 is removable from the remote end of the arm sleeve by conventional means such as complementary snaps designated by reference numerals 14, 16 or VELCRO. As discussed above with regard to the FIG. 3 embodiment, the remote end of the arm sleeve can be provided with conventional closure means, as for example snaps 18 or VELCRO, to enable the opened end of the sleeve to be closed, at the selection of the user, when the pacifier is removed from the remote end of the sleeve.

The embodiments discussed herein provide a versatile infant garment providing the user with several different modes of use, at the selection of the user. For example, the garment may have a non-detachable arm sleeve with a non-detachable or detachable pacifier; a detachable arm sleeve with a non-detachable or detachable pacifier; and closure means for closing the remote end of the arm sleeve when the pacifier is removed, all at the selection of the user. Moreover, the detached arm sleeve in the embodiments in which the arm sleeve is removable from the main body of the garment, can be used as a pillow or blanket.

Other modifications and advantages of the infant garments disclosed herein falling within the scope of the present invention will become apparent to persons skilled in the relevant art. Accordingly, the infant garments in accordance with the preferred embodiments of the invention disclosed herein are intended to be illustrative only, and not restrictive of the scope of the invention, that scope being defined by the following claims and all equivalents thereto.

The invention claimed is:

1. An infant garment comprising a main body and two arm sleeves extending from said main body, at least one of said arm sleeves being removably attached to said main body, and a pacifier attached to the remote end of said at least one arm sleeve, wherein the pacifier is formed as a unit with said at least one arm sleeve, said pacifier comprising a generally circular base and a nipple extending from said base, said base and said remote end of said at least one arm sleeve having complementary mating fastening systems for directly attaching the base of said pacifier to the remote end of said at least one arm sleeve.

2. The infant garment as claimed in claim 1, wherein said at least one arm sleeve is formed from a material such that said at least one arm sleeve comprises a pillow when removed from said main body.

3. The infant garment as claimed in claim 1, wherein said at least one arm sleeve is formed from a material such that said at least one arm sleeve comprises a blanket when removed from said main body.

4. The infant garment as claimed in claim 1, wherein said infant garment is a swaddling garment.

5. The infant garment as claimed in claim 1, wherein said infant garment is a sleep sack.

6. An infant garment comprising a main body and two arm sleeves extending from said main body, at least one of said arm sleeves being non-removably attached to said main body, and a pacifier attached to the remote end of said at least one arm sleeve, wherein the pacifier is formed as a unit with said at least one arm sleeve, said pacifier comprising a generally circular base and a nipple extending from said base, said base and said remote end of said at least one arm sleeve having complementary mating fastening systems for directly engaging each other for directly attaching the base of said pacifier to the remote end of said at least one arm sleeve.

7. The infant garment as claimed in claim 6, wherein said infant garment is a swaddling garment.

8. The infant garment as claimed in claim 6, wherein said infant garment is a sleep sack.

9. The infant garment as claimed in claim 1, wherein the other said arm sleeve is removably attached to said main body.

10. The infant garment as claimed in claim 6, wherein the other said arm sleeve is removably attached to said main body.

11. The infant garment as claimed in claim 1, wherein said main body is shaped in a generally peanut shaped configuration.

* * * * *